US010737314B2

(12) United States Patent
Heutling et al.

(10) Patent No.: US 10,737,314 B2
(45) Date of Patent: Aug. 11, 2020

(54) METHOD FOR PRODUCING FORGED TIAL COMPONENTS

(71) Applicant: MTU Aero Engines AG, München (DE)

(72) Inventors: Falko Heutling, Munich (DE); Claudia Kunze, Petershausen (DE); Ulrike Habel, Munich (DE)

(73) Assignee: MTU Aero Engines AG, Munich (DE)

( * ) Notice: Subject to any disclaimer, the term of this patent is extended or adjusted under 35 U.S.C. 154(b) by 166 days.

(21) Appl. No.: 15/915,290

(22) Filed: Mar. 8, 2018

(65) Prior Publication Data

US 2018/0257127 A1 Sep. 13, 2018

(30) Foreign Application Priority Data

Mar. 10, 2017 (EP) ..... 17160397

(51) Int. Cl.

| | |
|---|---|
| ***B21J 5/02*** | (2006.01) |
| ***C22C 14/00*** | (2006.01) |
| ***C22F 1/18*** | (2006.01) |
| ***B21J 1/06*** | (2006.01) |
| ***F01D 5/14*** | (2006.01) |
| ***F01D 5/28*** | (2006.01) |

(52) U.S. Cl.

CPC ..... *B21J 5/025* (2013.01); *B21J 1/06* (2013.01); *C22C 14/00* (2013.01); *C22F 1/183* (2013.01); *F01D 5/147* (2013.01); *F01D 5/286* (2013.01); *F05D 2220/323* (2013.01); *F05D 2230/10* (2013.01); *F05D 2230/25* (2013.01); *F05D 2230/41* (2013.01); *F05D 2300/174* (2013.01)

(58) Field of Classification Search

CPC ... B21J 5/025; B21J 1/06; C22F 1/183; C22C 14/00; F01D 5/147; F01D 5/286; F01D 5/283

See application file for complete search history.

(56) References Cited

U.S. PATENT DOCUMENTS

| | | | |
|---|---|---|---|
| 8,864,918 | B2 | 10/2014 | Clemens et al. |
| 2014/0202601 | A1 | 7/2014 | Helm et al. |
| 2016/0265096 | A1 | 9/2016 | Janschek et al. |

FOREIGN PATENT DOCUMENTS

| | | | |
|---|---|---|---|
| DE | 10 2011 110 740 | B4 | 2/2013 |
| DE | 10 2015 103 422 | B3 | 7/2016 |
| EP | 2 386 663 | A1 | 11/2011 |

OTHER PUBLICATIONS

Brooks et al: "Three-dimensional finite element modelling of a titanium aluminide aerofoil forging", Journal of Materials Processing Techno, Elsevier, NL, vol. 80-81. Aug. 1, 1998 (Aug. 1, 1998), pp. 149-155.

Kim et al: "Microstructural evolution and mechanical properties of a forged gamma titanium aluminide alloy", Acta Metallurgica & Materialien Pergamon/ Elsevier Science Ltd, GB, vol. 40. No. 6. Jun. 1, 1992 (Jun. 1, 1992), pp. 1121-1134.

Srinivasan R et al: "Temperature changes and loads during hot-die forging of a gamma titanium-aluminide alloy", Journal of Materials Processing Technology, Elsevier, NL, vol. 160. No. 3. Mar. 30, 2005 (Mar. 30, 2005), Seiten 321-334.

*Primary Examiner* — Jessee R Roe

(74) *Attorney, Agent, or Firm* — Davidson, Davidson & Kappel, LLC

(57) ABSTRACT

A method for producing a forged component from a TiAl alloy is provided, in particular a turbine blade (10), in which method a blank of a TiAl alloy is provided and deformed by forging into a forged, semi-finished part (9). A usable volume is defined within the forged, semi-finished part, the usable volume corresponding to the forged component to be produced. The shape of the blank is selected such that within the usable volume of the forged, semi-finished part, the degree of deformation resulting from forging deviates by no more than ±1 from a defined value.

34 Claims, 4 Drawing Sheets

METHOD FOR PRODUCING FORGED TIAL COMPONENTS

This is claims the benefit of European Patent Application EP 17160397.0 filed Mar. 10, 2017 which is hereby incorporated by reference herein.

The present invention relates to a method for producing forged components from a TiAl alloy, in particular components for gas turbines, preferably aircraft turbines and in particular turbine blades for low-pressure turbines.

BACKGROUND

Due to their low specific weight and their mechanical properties, components made of titanium aluminides or TiAl alloys are of interest for use in gas turbines, in particular aircraft turbines.

Titanium aluminides or TiAl alloys are understood to be alloys which include titanium and aluminum as the main constituents, so that aluminum and titanium are the components present in the highest proportions in the chemical composition thereof. Moreover, TiAl alloys are characterized by the formation of intermetallic phases, such as γ-TiAl or $\alpha_2$-$Ti_3Al$, which give the material good strength properties.

However, TiAl alloys are not easy to process, and the microstructures of TiAl materials have to be precisely adjusted to obtain the desired mechanical properties.

DE 10 2011 110 740 B4, for example, describes a method for producing forged TiAl components, where a two-stage heat treatment is performed subsequent to forging in order to obtain the desired microstructure. Documents DE 10 2015 103 422 B3 and EP 2 386 663 A1 also disclose methods for producing components from TiAl alloys.

European Laid-Open Application EP 2 386 663 A1 already addresses the problem that TiAl alloys can often have an inhomogeneous microstructure and, therefore, the properties of the TiAl material also exhibit inhomogeneities. However, this is undesirable when using the TiAl alloys in turbomachines such as aircraft engines. In this regard, EP 2 386 663 A1 proposes to subject the deformed TiAl material to a heat treatment to achieve recrystallization. However, this does not completely solve the problem of the formation of inhomogeneous microstructures.

SUMMARY OF THE INVENTION

It is an object of the present invention to provide a method for producing components from TiAl materials that can be used in gas turbines, in particular aircraft turbines, preferably in the low-pressure turbine section, and which have a homogeneous microstructure and thus a homogeneous property profile.

In a forging method for producing a forged component from a TiAl alloy, the present invention proposes that deformation by forging be implemented in such a manner that homogeneous deformation will occur throughout the entire component. This is because it has been found that when the deformation is homogeneous throughout the entire component, a homogeneous microstructure can be achieved in the forged component in a simple way, so that the property profile of the forged component is also homogeneous throughout the entire component. Accordingly, the shape of a blank provided for forging is selected such that the deformation is substantially uniform throughout the entire volume of the blank or of the semi-finished part forged from the blank. To this end, a defined degree of deformation is selected, and deviation therefrom is only ±1 throughout the entire usable volume of the forged, semi-finished part. The term "usable volume of the forged, semi-finished part" is understood to be the portion of the forged, semi-finished part that corresponds to the forged component to be produced, for example, the area or volume of a turbine blade to be produced. Accordingly, the usable volume of the forged, semi-finished part is understood to be the portion of the forged, semi-finished part that will remain as a finished component upon subsequent material-removing machining. Thus, a "forged, semi-finished part" can be understood to be, in particular, a forged blank or forged intermediate product which can be machined into a finished component, such as a turbine blade, in one or more machining steps. A "blank" can be understood to be, in particular, a forging feedstock which can be processed into semi-finished part by a forging process.

In the case of a one-dimensional change in size in a Cartesian reference system, the degree of deformation φ is defined as the natural logarithm of the ratio of the finished size $x_1$ after deformation to the original size $x_0$. In the case of a three-dimensional deformation, the deformation is characterized by the greatest degree of deformation $\varphi_g$, which is expressed as:

$$\varphi_g=|\varphi_{max}|=\tfrac{1}{2}(|\varphi_x|+|\varphi_y|+|\varphi_z|)$$

where $\varphi_x$, $\varphi_y$, $\varphi_z$ are the degrees of deformation in the x-, y- and z-directions.

The blank may be shaped such that, during deformation into the desired, forged semi-finished part, the degree of deformation in one of the directions of the reference system (i.e., for example, the x-, y- or z-direction of a Cartesian reference system) has a defined value and deviates therefrom only within the permissible range of variation, or that the degree of deformation in several directions of the reference system or in each direction, in particular each principal direction, of the reference system has a defined value and deviates therefrom only within the permissible range of variation. Moreover, the blank may also be configured in such a way that, among the degrees of deformation of different directions, the highest-value degree of deformation and/or the lowest-value degree of deformation value meet(s) the predetermined homogeneous deformation conditions.

In particular, the shape of the blank may be selected such that the deformation to be performed has a defined degree of deformation which, within the usable volume of the forged, semi-finished part, deviates from the defined value of the degree of deformation by no more than ±0.5, in particular ±0.25.

The defined value of the degree of deformation may, in particular, be greater than or equal to 0.7, so that a minimum deformation takes place to this extent. Preferably, the degree of deformation should be no less than 0.7 within the usable volume, so that the entire material of the forged, semi-finished part undergoes a minimum deformation by the forging process.

Moreover, the defined value of the degree of deformation may be kept as low as possible in order to minimize the deformation effort. Accordingly, the value of the degree of deformation may be less than or equal to 2.5, in particular less than or equal to 2.0.

The rate of deformation during forging; i.e., the change of the degree of deformation per unit time, may lie in the range of from 0.01 to 0.5 per second, and in particular in the range of from 0.025 to 0.25 per second.

Moreover, the shape of the blank may be selected such that along the longitudinal axis of the blank; i.e., the axis having the largest dimension, the mass is distributed in such a way that more mass is present at the two ends than in the middle of the blank. For this purpose, the blank may be divided along its longitudinal axis into three portions or sections of equal length, namely a first and a second end portion as well as a middle portion, the mass of the blank being distributed in these portions in such a way that more mass is present in the end portions than in the middle portion. Accordingly, the blank may be configured such that the following holds: $M_M < M_{E1} \leq M_{E2}$, where $M_M$ is the mass of the blank in the middle portion, ME1 is the mass of the blank in the first end portion and $M_{E2}$ is the mass of the blank in the second end portion.

Moreover, the blank may meet the following condition: $M_M \leq M_{E2}/1.25$.

TiAl alloys suitable for producing forged components, in particular gas turbine components such as, for example, low-pressure turbine blades, include primarily titanium aluminide alloys alloyed with niobium and molybdenum. Such alloys are also referred to as TNM alloys.

An alloy suitable for use in the present method is one having 27 to 30 percent by weight of aluminum, 8 to 10 percent by weight of niobium, and 1 to 3 percent by weight of molybdenum. The remainder may be constituted of titanium.

The aluminum content may in particular be in the range of from 28.1 to 29.1 percent by weight of aluminum, while 8.5 to 9.6 percent by weight of niobium and 1.8 to 2.8 percent by weight of molybdenum may be added to the alloy.

In addition, the alloy may be alloyed with boron, namely in the range of from 0.01 to 0.04 percent by weight of boron, in particular 0.019 to 0.034 percent by weight of boron.

Further, the alloy may contain unavoidable impurities and other constituents, such as carbon, oxygen, nitrogen, hydrogen, chromium, silicon, iron, copper, nickel and yttrium. The concentrations of these constituents may be ≤0.05 percent by weight of chromium, ≤0.05 percent by weight of silicon, ≤0.08 percent by weight of oxygen, ≤0.02 percent by weight of carbon, ≤0.015 percent by weight of nitrogen, ≤0.005 percent by weight of hydrogen, ≤0.06 percent by weight of iron, ≤0.15 percent by weight of copper, ≤0.02 percent by weight of nickel and ≤0.001 percent by weight of yttrium. Other constituents may be included in amounts in the range of from 0 to 0.05 percent by weight each, or in a total amount of from 0 to 0.2 percent by weight.

The forging of the blank may be performed in particular as an isothermal forging process, in which only a single-stage deformation; i.e., only one deformation step, may be performed, preferably in only one forging die set, without any additional deformation or forging taking place in another forging die set. In this way, the deformation effort can be kept low.

In this context, the term "single-stage" means both that the deformation process takes place in a single continuous operation and that only one deformation takes place in the production process.

Accordingly, the deformation of the, for example, cast but not yet deformed blank into the semi-finished part can be accomplished in a single forging step, without any additional deformation being required to produce the finished component. Thus, there is no need for pressing multiple times and from different directions, but rather only one press is required; i.e., one die set including two dies between which the blank is inserted and deformed as the two dies are pressed toward one another. Consequently, there is no need for the forged part to be repositioned or moved between different forging steps.

The forging of the respective components may be accomplished by closed-die forging in the temperature range of the $\alpha+\gamma+\beta$ phase region. In this process, the forging temperature may be in the range of from 1150° C. to 1200° C. A corresponding die set may be maintained by heating at such temperature during the forging process. Depending on the material of the die set, an inert ambient atmosphere may be provided during forging.

Subsequent to forging, the forged, semi-finished parts may be subjected to a two-stage heat treatment, the first stage of which provides for recrystallization annealing below the $\gamma/\alpha$ transition temperature for a period of 50 to 100 minutes. The annealing at a temperature below the $\gamma/\alpha$ transition temperature, at which, according to the phase diagram for the TiAl alloy used, $\alpha$-titanium is converted into $\gamma$-TiAl, can take place at a temperature as close as possible to the $\gamma/\alpha$ transition temperature. During this process, the temperature should not fall below a value of 8%, in particular 4%, below the $\gamma/\alpha$ transition temperature.

The recrystallization annealing may preferably be carried out for 60 to 90 minutes, in particular 70 to 80 minutes.

The first stage of the heat treatment, which includes recrystallization annealing, may be followed by a second stage off the heat treatment, which includes stabilization annealing in the temperature range of from 800° C. to 950° C. for 5 to 7 hours.

The stabilization annealing may be carried out in particular in the temperature range of from 825° C. to 925° C., preferably from 850° C. to 900° C., with a holding period of 345 minutes to 375 minutes.

The cooling during recrystallization annealing may be effected by air cooling. During this process, in the temperature range of between 1300° C. and 900° C., the cooling rate should be >3° C. per second in order to obtain a fine lamellar microstructure of $\alpha_2$-$Ti_3$ Al and $\gamma$-TiAl, which ensures the required mechanical properties.

The cooling during the second heat treatment stage; i.e. the stabilization annealing, may be performed at correspondingly lower cooling rates in the furnace.

For the adjustment of the microstructure and the reproducibility of a corresponding microstructure adjustment, it is important that the heat treatment steps be performed at temperatures as close as possible to those selected. However, an increasingly exact adjustment of the temperature and maintenance of the components at the respective temperatures is associated with increasing complexity, and therefore a compromise has to be found for economically viable processing. For the heat treatment of forged TiAl components, a temperature adjustment with an upward and downward deviation in the range of from 5° C. to 10° C. from the setpoint temperature has proved to be advantageous. Accordingly, the setpoint temperature selected for the heat treatment steps of the present invention can be set and maintained in a corresponding temperature window with an upward and downward deviation of 5° C. to 10° C. from the setpoint temperature.

Cast and/or hot-isostatically pressed blanks can be used as blanks for forging. As an alternative to casting, the raw stock may also be produced by metal injection molding (MIM), powder-metallurgical methods, additive methods (e.g., 3D printing, deposition welding) or combinations thereof. Regardless of the method of production, the blanks or raw stock may be hot-isostatically pressed prior to forging. It may be advantageous to machine the raw stock on all sides or locally prior to forging using a material-removing machining process to machine off near-surface zones and/or to give the blank the desired shape for the subsequent deformation process. Material-removing machining may be accomplished using any suitable method, in particular mechanical machining processes or electrochemical machining processes.

The blanks may be produced by melting under vacuum or inert gas using consumable electrodes or in a cooled crucible by means of plasma arc melting. In this process, the alloy may be remelted once or multiple times. The remelting may be accomplished by means of vacuum induction melting (VIM) or vacuum arc remelting (VAR), and the cast material may be subjected to hot-isostatic pressing, it being possible to use temperatures 1200° C. at a pressure 100 MPa and a holding period 4 hours.

After forging and prior or preferably subsequent to the two-stage heat treatment, the forged, semi-finished part may be subjected to subsequent machining using a material-removing machining process to produce the finished component. Material-removing machining may be accomplished using any suitable method, in particular mechanical machining processes or electrochemical machining processes.

BRIEF DESCRIPTION OF THE DRAWINGS

The accompanying drawings show purely schematically in

DETAILED DESCRIPTION

Other advantages, characteristics and features of the present invention will become apparent from the following detailed description of the exemplary embodiments. However, the present invention is not limited to such exemplary embodiments.

Figure 1A:
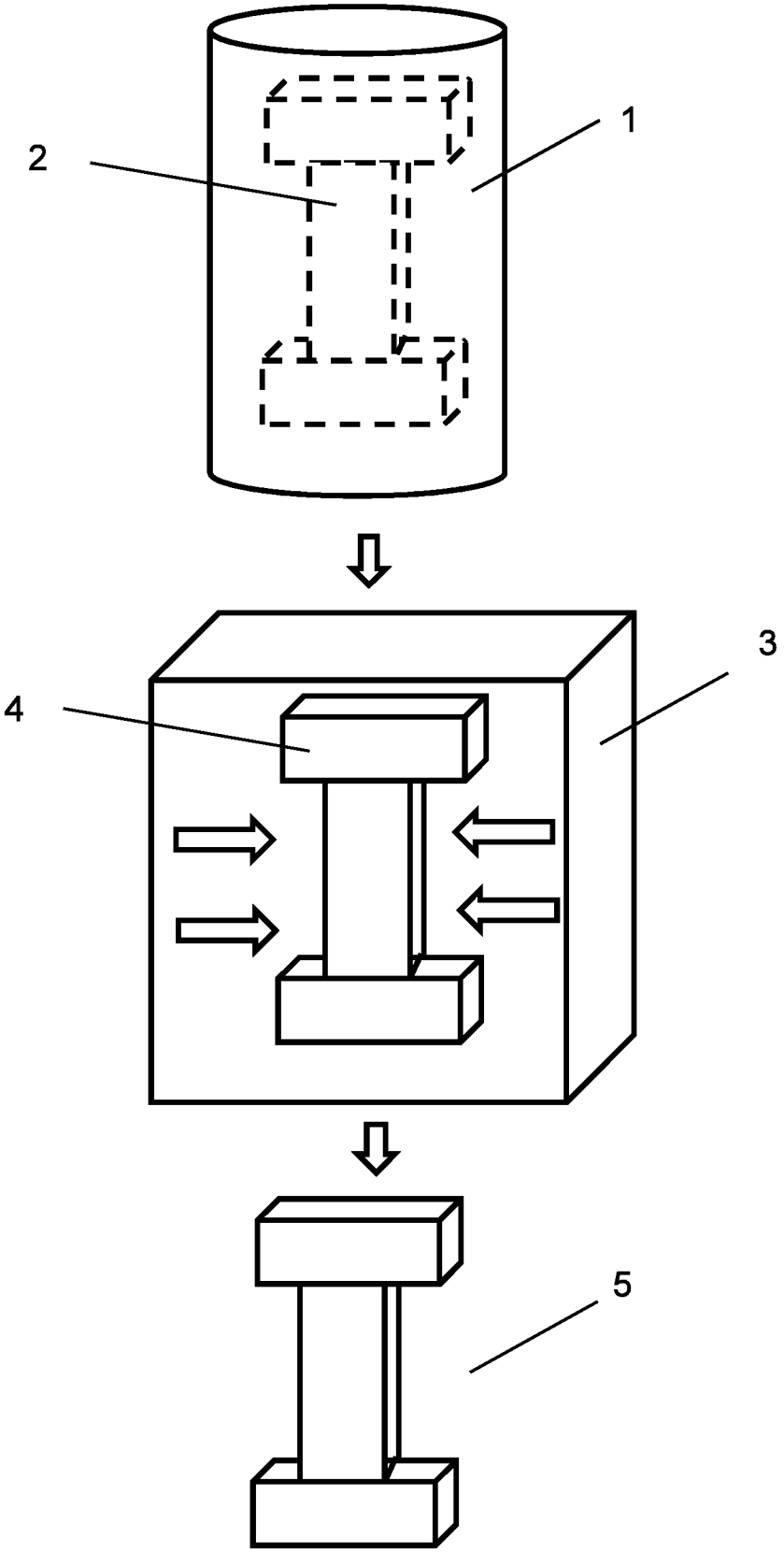
FIGS. 1*a* and 1*b* a process sequence for manufacturing a turbine blade in accordance with the present invention.
Figure 1B:
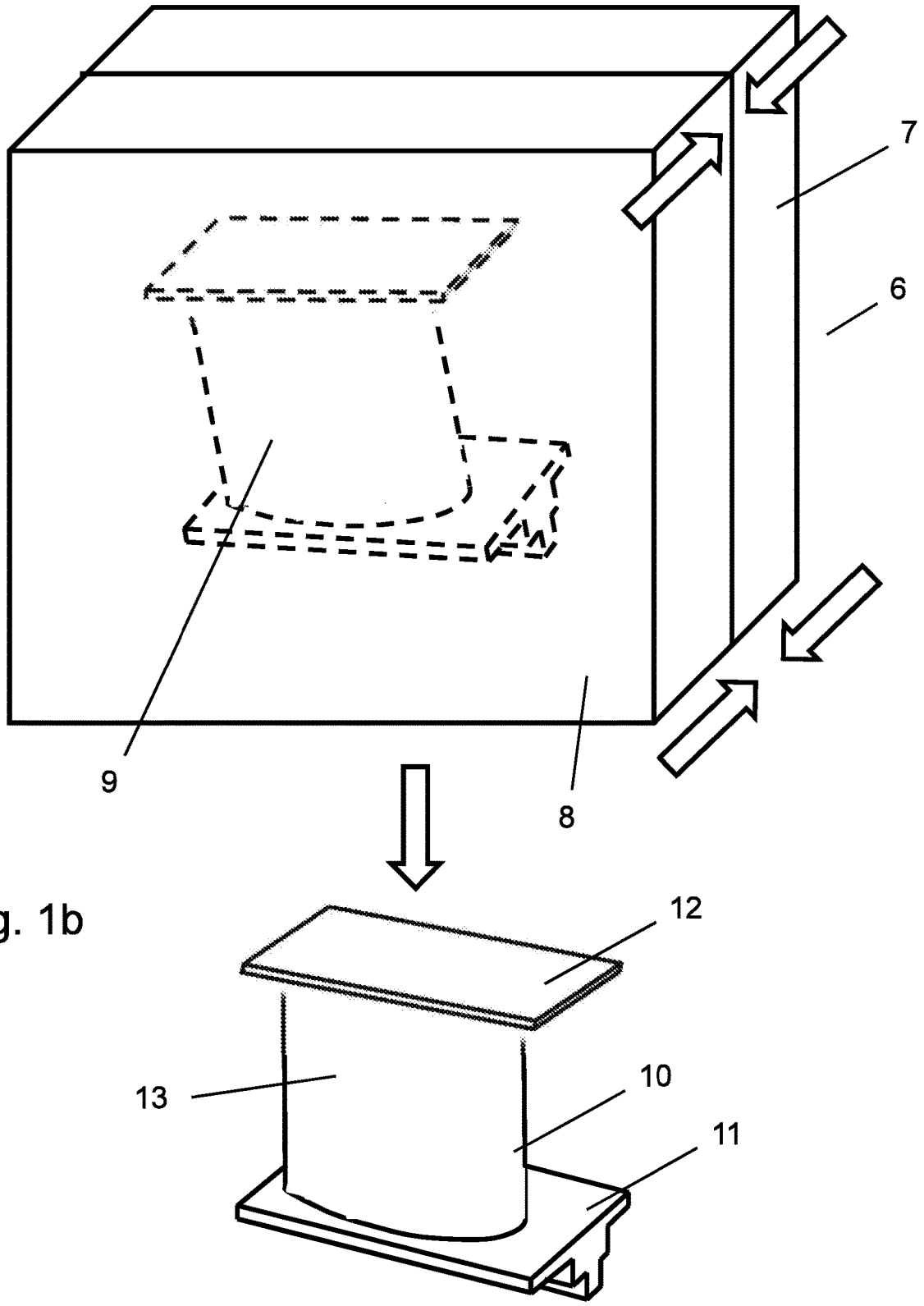

FIGS. 1*a* and 1*b* a show the sequence of process steps performed in an exemplary embodiment of the method according to the present invention.

Initially, a blank 5 is produced by pouring a molten TiAl alloy into a casting mold 1 having a cavity 2 which corresponds to the shape of the blank 5 to be produced.

After the TiAl alloy has been cast in mold 1 and solidified, cast blank 4 may be hot-isostatically pressed in a machine 3 for hot isostatic pressing in order to densify cast blank 4 and to close possible casting voids or the like. Thus, the hot isostatic pressing is not used for deforming cast blank 4, but only for densifying the material.

Thereafter, blank 5 may in addition be subjected to material-removing machining, for example, by mechanical machining processes or by electrochemical machining.

The blank 5 so produced is forged to a near-net-shape, semi-finished part 9 in a drop forge 6, the drop forge 6 having two drop-forge dies 7 and 8 defining a cavity therebetween which corresponds to the shape of the semi-finished part 9 to be forged, as indicated in dashed lines in FIG. 1*b*. By pressing drop-forge dies 7 and 8 together, with blank 5 located therebetween, the TiAl alloy is deformed into the forged, semi-finished part 9. By suitably heating drop-forge dies 7 and 8, the deformation of blank 5 into forged, semi-finished part 9 can be performed by isothermal forging at as constant a temperature as possible. The pressing together of drop-forge dies 7 and 8 is indicated by arrows in FIG. 1*b*.

After isothermal forging, a near-net-shape, forged semi-finished part 9 is present which may be formed into the finished component, namely a turbine blade 10, by subsequent, material-removing machining. The subsequent machining by removal of material may be performed using mechanical machining processes or electrochemical machining processes.

After the subsequent machining, a finished turbine blade 10 is present which has an airfoil 13, a blade root 11 and a shroud 12.

As is apparent from FIGS. 1*a* and 1*b*, in the method according to the present invention, a near net shape of the component to be produced can be obtained in a single deformation step through isothermal forging in a drop forge 6, which makes it possible to minimize subsequent machining. Because the present invention uses, for isothermal forging, a blank 5 whose shape is adapted for isothermal closed-die forging, it is ensured, in particular, that during the deformation of blank 5 into the forged, semi-finished part 9, as uniform a deformation as possible takes place throughout the component, without failing to achieve a minimum deformation, but allowing the deformation to be kept as small as possible. This makes it possible to obtain a homogeneous microstructure for the TiAl alloy, so that the material properties are homogeneous throughout the finished turbine blade 10.

Figure 2:
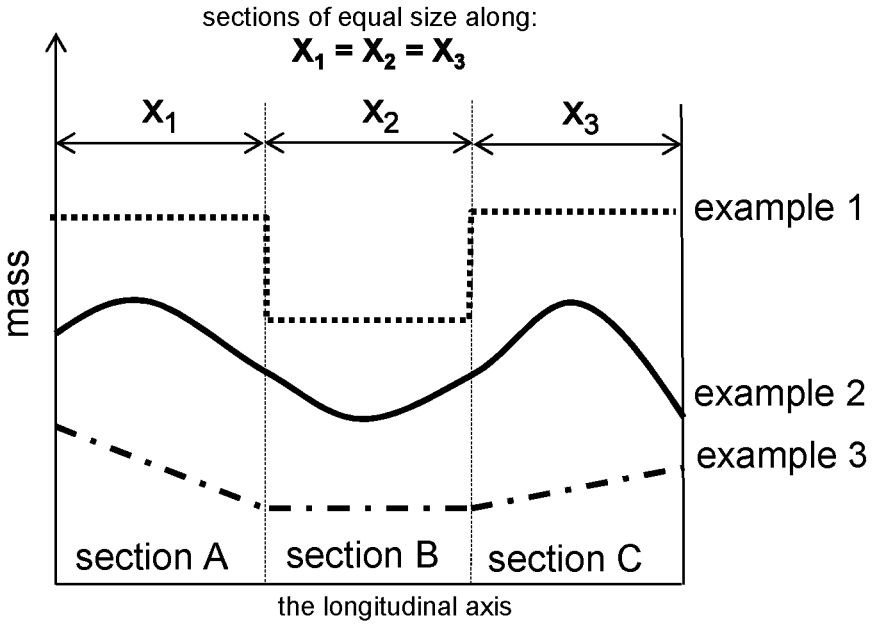
in FIG. 2 a diagram for illustrating possible mass distributions in a blank for the forging operation; and in FIG. 3 an equilibrium diagram for a TiAl alloy as may be used in the present invention, indicating the phase field in which forging or deformation takes place.

FIG. 2 shows, in examples 1 through 3, different mass distribution profiles along the longitudinal axis of blank 5 as may be used in the present invention. FIG. 2 illustrates that a blank 5 may be divided into sections of equal size along the longitudinal axis of blank 5, these sections containing different masses of the blank, namely more mass at the two ends of the longitudinal axis than in a middle portion. The masses in the respective portions at the ends may be equal or unequal.

Figure 3:
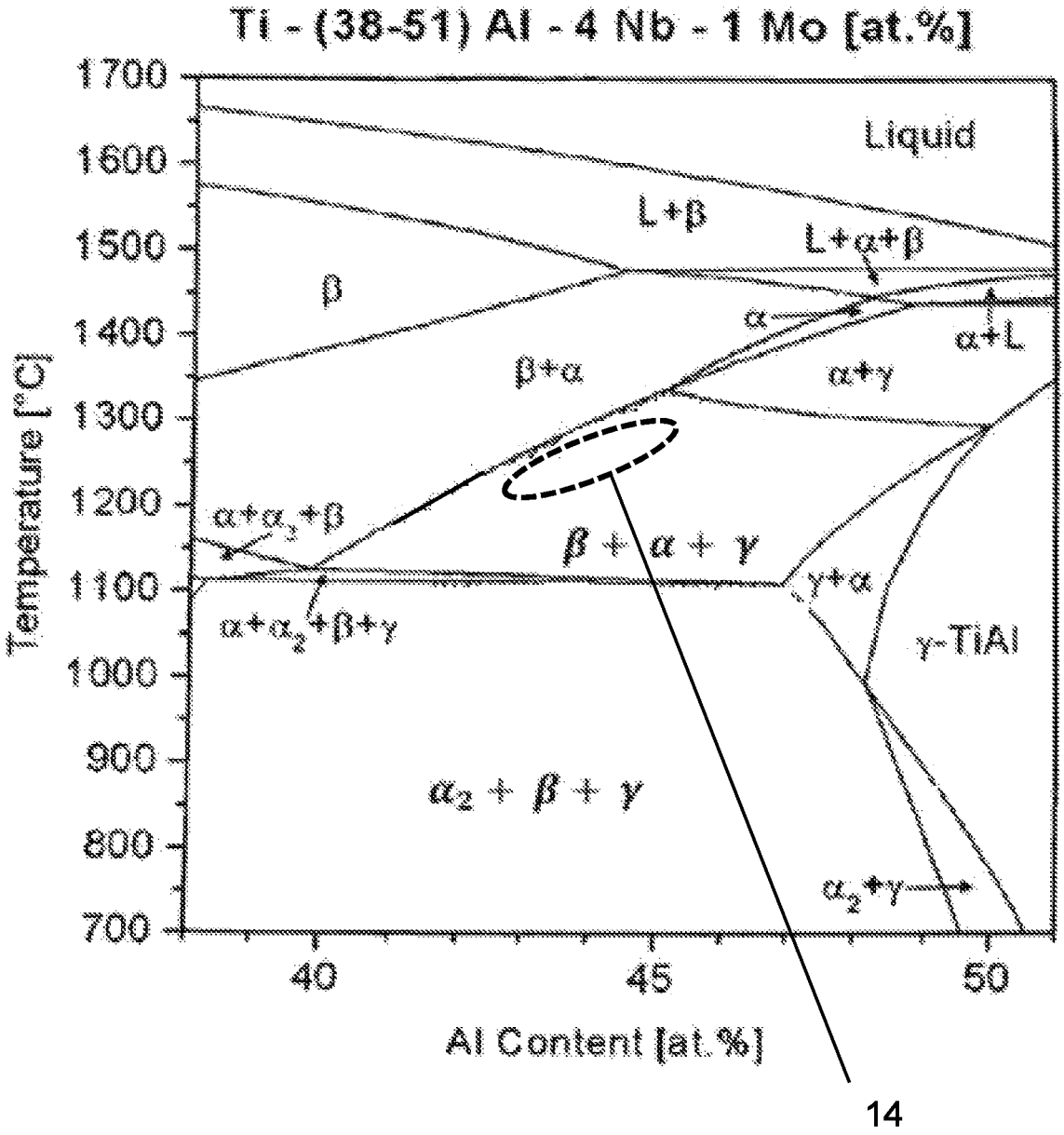

FIG. 3 shows a so-called pseudobinary phase diagram of a TiAl alloy as may be used in the present invention. The term "pseudobinary" means that in the phase region shown, only the percentages of two constituents, here Ti and Al, change, while the other alloy constituents, here Nb and Mo, remain constant. The dashed phase field 14 in which processing occurs lies in the $\alpha+\beta+\gamma$ phase region and indicates the temperature range within which isothermal forging can be performed for the respective composition of the TiAl alloy. In the phase diagram, the $\gamma/\alpha$ transition temperature corresponds to the line between the $\beta+\alpha$ phase region and the $\alpha+\beta+\gamma$ phase region.

Although the present invention has been described in detail with reference to the exemplary embodiments thereof, those skilled in the art will understand that it is not intended to be limited thereto and that modifications may be made by omitting individual features or by combining features in different ways, without departing from the protective scope of the appended claims.

LIST OF REFERENCE NUMERALS

1 casting mold
2 cavity
3 machine for hot isostatic pressing
4 cast blank
5 blank
6 drop forge

7 drop-forge die
8 drop-forge die
9 forged, semi-finished part
10 turbine blade
11 blade root
12 shroud
13 airfoil
14 phase field in which processing occurs

What is claimed is:

1. A method for producing a forged component from a TiAl alloy, comprising:

providing a blank of a TiAl alloy;

deforming the blank by forging into a forged, semi-finished part, a usable volume being defined within the forged, semi-finished part, the usable volume corresponding to the forged component to be produced; and selecting a shape of the blank such that within the usable volume of the forged, semi-finished part, a degree of deformation $\varphi_g$ has a selected defined value and a deviation from the selected defined value resulting from the forging is no more than ±1 from the selected defined value over the usable volume;

where $\varphi_g=|\varphi_{max}|=\frac{1}{2}(|\varphi_x|+|\varphi_y|+|\varphi_z|)$ and where $\varphi_x$, $\varphi_y$, $\varphi_z$ are degrees of deformation in the x, y and z directions and are each defined as the natural logarithm of a ratio of a finished dimension in the x, y or z direction after the deformation to an original dimension in the corresponding x, y or z direction.

2. The method as recited in claim 1 wherein the degree of deformation $\varphi_g$ deviates from the selected defined value by no more than ±0.25.

3. The method as recited in claim 1 wherein the selected defined value of the degree of deformation $\varphi_g$ is greater than or equal to 0.7, the degree of deformation $\varphi_g$ being no less than 0.7 within the usable volume.

4. The method as recited in claim 1 wherein the selected defined value of the degree of deformation is less than or equal to 2.5.

5. The method as recited in claim 1 wherein the selected defined value of the degree of deformation is less than or equal to 2.0.

6. The method as recited in claim 1 wherein a rate of deformation lies in the range of from 0.01 to 0.5 per second.

7. The method as recited in claim 1 wherein a rate of deformation lies in the range of from 0.025 to 0.25 per second.

8. The method as recited in claim 1 wherein the shape of the blank is selected such that the blank is divided into three portions of equal size along the longitudinal axis of blank to define a first and a second end portion as well as a middle portion, the following holding: $M_M<M_{E1}\leq M_{E2}$, where $M_M$ is the mass of the blank in the middle portion, $M_{E1}$ is the mass of the blank in the first end portion and $M_{E2}$ is the mass of the blank in the second end portion.

9. The method as recited in claim 8 wherein $M_M\leq M_{E2}/1.25$.

10. The method as recited in claim 1 wherein the TiAl alloy includes niobium and molybdenum.

11. The method as recited in claim 10 wherein the TiAl alloy contains 27 to 30 percent by weight of aluminum, 8 to 10 percent by weight of niobium, and 1 to 3 percent by weight of molybdenum.

12. The method as recited in claim 10 wherein the TiAl alloy contains 0.01 to 0.04 percent by weight of boron.

13. The method as recited in claim 10 wherein the TiAl alloy, in addition to unavoidable impurities, contains at least one additional constituent selected from the group including carbon, oxygen, nitrogen, hydrogen, chromium, silicon, iron, copper, nickel and yttrium.

14. The method as recited in claim 13 wherein concentrations of the TiAl alloy include ≤0.05 percent by weight of chromium, ≤0.05 percent by weight of silicon, ≤0.08 percent by weight of oxygen, ≤0.02 percent by weight of carbon, ≤0.015 percent by weight of nitrogen, ≤0.005 percent by weight of hydrogen, ≤0.06 percent by weight of iron, ≤0.15 percent by weight of copper, ≤0.02 percent by weight of nickel and ≤0.001 percent by weight of yttrium.

15. The method as recited in claim 13 wherein the TiAl alloy is used whose chemical composition contains titanium in an amount which, together with niobium, molybdenum, any additional constituents selected from the group including carbon, oxygen, nitrogen, hydrogen, chromium, silicon, iron, copper, nickel and yttrium, and unavoidable impurities, makes up 100 percent by weight of the alloy.

16. The method as recited in claim 1 wherein the deformation is accomplished by isothermal forging in the temperature range of the α+γ+β phase region of the TiAl alloy.

17. The method as recited in claim 16 wherein the forging temperature is between 1150° C. and 1200° C.

18. The method as recited in claim 16 wherein the forging is closed-die forging.

19. The method as recited in claim 1 wherein the deformation is accomplished by isothermal forging, and after the deformation by the isothermal forging, the TiAl alloy is subjected to a two-stage heat treatment, the first stage of the heat treatment including recrystallization annealing for 50 to 100 minutes at a temperature below the γ/α transition temperature, and the second stage of the heat treatment including stabilization annealing in the temperature range of from 800° C. to 950° C. for 5 to 7 hours, and the cooling rate during the first heat treatment stage in the temperature range of between 1300° C. and 900° C. being greater than or equal to 3° C./s.

20. The method as recited in claim 19 wherein the recrystallization annealing is performed for 60 to 90 minutes or the stabilization annealing is performed in the temperature range of from 825° C. to 925° C. or for 345 to 375 minutes.

21. The method as recited in claim 20 wherein the recrystallization annealing is performed for 70 to 80 minutes, or the stabilization annealing is performed in the temperature range of from 850° C. to 900° C.

22. The method as recited in claim 19 wherein during the two-stage heat treatment, the temperature is set and maintained at an accuracy of 5° C. to 10° C. of upward and downward deviation from the setpoint temperature.

23. The method as recited in claim 1 wherein the blank is provided from raw stock and produced using at least one method selected from the group including casting, metal injection molding, powder-metallurgical methods, additive methods, 3D printing, deposition welding, hot isostatic pressing, and material-removing machining processes.

24. The method as recited in claim 1 wherein the deformation is performed in a single-stage deformation step.

25. The method as recited in claim 24 wherein the deformation is performed in a forging die set.

26. The method as recited in claim 24 wherein the deformation includes an isothermal forging performed as a closed-die forging with a heated die set.

27. The method as recited claim 1 wherein the blank provided is unforged and is formed into the semi-finished part in only one forging step.

28. The method as recited in claim 27 wherein the only one forging step is performed by pressing two dies of a die set toward one another, each in only one respective direction, so as to deform the blank located therebetween into the semi-finished part.

29. The method as recited in claim 1 wherein the forged, semi-finished part is subsequently machined using a material-removing machining process so as to produce the forged component.

30. The method as recited in claim 29 wherein the material-removing machining process includes mechanical machining or electrochemical machining.

31. The method as recited in claim 29 wherein the mechanical machining includes milling.

32. The method as recited in claim 1 wherein the forged component is a blade of a turbomachine.

33. The method as recited in claim 32 wherein the blade is a turbine blade.

34. The method as recited in claim 33 wherein the turbine blade is a low-pressure turbine.

* * * * *